US009593401B2

(12) United States Patent
Takahashi et al.

(10) Patent No.: US 9,593,401 B2
(45) Date of Patent: Mar. 14, 2017

(54) CONTINUOUS ANNEALING FURNACE FOR STEEL STRIP, CONTINUOUS ANNEALING METHOD, CONTINUOUS GALVANIZING APPARATUS AND METHOD FOR MANUFACTURING GALVANIZED STEEL STRIP (AS AMENDED)

(71) Applicant: JFE STEEL CORPORATION, Chiyoda-ku, Tokyo (JP)

(72) Inventors: Hideyuki Takahashi, Fukuyama (JP); Nobuyuki Sato, Chiba (JP); Kazuki Nakazato, Chiba (JP); Motoki Takada, Chiba (JP)

(73) Assignee: JFE Steel Corporation, Tokyo (JP)

( * ) Notice: Subject to any disclaimer, the term of this patent is extended or adjusted under 35 U.S.C. 154(b) by 39 days.

(21) Appl. No.: 14/402,556

(22) PCT Filed: May 20, 2013

(86) PCT No.: PCT/JP2013/003199
§ 371 (c)(1),
(2) Date: Nov. 20, 2014

(87) PCT Pub. No.: WO2013/175758
PCT Pub. Date: Nov. 28, 2013

(65) Prior Publication Data

US 2015/0140217 A1 May 21, 2015

(30) Foreign Application Priority Data

May 24, 2012 (JP) ..... 2012-118116

(51) Int. Cl.
*B05D 3/02* (2006.01)
*B05D 7/14* (2006.01)
(Continued)

(52) U.S. Cl.
CPC ..... *C23C 2/02* (2013.01); *C21D 1/26* (2013.01); *C21D 1/74* (2013.01); *C21D 1/76* (2013.01);
(Continued)

(58) Field of Classification Search
CPC .. C23C 2/00; C23C 2/02; C23C 2/003; C23C 2/40; B05D 3/0218; B05D 7/14;
(Continued)

(56) References Cited

U.S. PATENT DOCUMENTS

| | | | |
|---|---|---|---|
| 8,097,205 | B2 | 1/2012 | Sugano |
| 2009/0123651 | A1 | 5/2009 | Okada |
| 2013/0273251 | A1 | 10/2013 | Takahashi |

FOREIGN PATENT DOCUMENTS

| | | |
|---|---|---|
| JP | 2567130 | 12/1996 |
| JP | 2567140 | 12/1996 |

(Continued)

OTHER PUBLICATIONS

Derwent abstract of JP 10-176225 A, published Jun. 1998.*

(Continued)

*Primary Examiner* — Kirsten Jolley
(74) *Attorney, Agent, or Firm* — RatnerPrestia

(57) ABSTRACT

Provided is a vertical annealing furnace, in which a heating zone and a soaking zone are communicated with each other in the upper part of the furnace, in which a part of the furnace other than the communicated parts is separated by a dividing wall, in which part of the furnace gas is suctioned into a refiner having a deoxidation device and a dehumidification device which is placed outside the furnace to decrease the dew point of the gas by removing oxygen and moisture from the gas and such that the resultant gas having a decreased dew point is returned into the furnace, in which a gas suction port into the refiner is located in the lower part of the (Continued)

connection part between the soaking zone and the cooling zone and in which one or more gas suction ports are located in the parts of the heating zone and/or the soaking zone outside of an area within 6 m in the vertical direction and 3 m in the longitudinal direction of the furnace from the steel strip entrance in the lower part of the heating zone.

20 Claims, 4 Drawing Sheets

(51) Int. Cl.

| | |
|---|---|
| ***B05C 3/15*** | (2006.01) |
| ***C23C 2/02*** | (2006.01) |
| ***F27B 9/28*** | (2006.01) |
| ***F27B 9/04*** | (2006.01) |
| ***C21D 1/74*** | (2006.01) |
| ***C21D 1/76*** | (2006.01) |
| ***C23C 2/06*** | (2006.01) |
| ***C23C 2/26*** | (2006.01) |
| ***C23C 2/28*** | (2006.01) |
| ***C23C 2/40*** | (2006.01) |
| ***C21D 9/56*** | (2006.01) |
| ***C21D 1/26*** | (2006.01) |
| ***F27D 7/04*** | (2006.01) |
| ***C23C 2/00*** | (2006.01) |

(52) U.S. Cl.
CPC ..... *C21D 9/56* (2013.01); *C21D 9/561* (2013.01); *C23C 2/003* (2013.01); *C23C 2/06* (2013.01); *C23C 2/26* (2013.01); *C23C 2/28* (2013.01); *C23C 2/40* (2013.01); *F27B 9/045* (2013.01); *F27B 9/28* (2013.01); *F27D 7/04* (2013.01); *B05D 3/0218* (2013.01); *B05D 7/14* (2013.01)

(58) Field of Classification Search
CPC ... C21D 1/26; C21D 1/74; C21D 1/76; C21D 9/56; C21D 9/561; F27B 9/045; F27B 9/28
USPC ..... 427/321; 118/419; 432/9, 77
See application file for complete search history.

(56) References Cited

FOREIGN PATENT DOCUMENTS

| | | | | |
|---|---|---|---|---|
| JP | 9324210 | | | 12/1997 |
| JP | 10-176225 | A | * | 6/1998 |
| JP | 2003129125 | | | 5/2003 |
| JP | 201146988 | | | 3/2011 |
| WO | 2007043273 | | | 4/2007 |
| WO | 2008099970 | | | 8/2008 |
| WO | 2012081719 | | | 6/2012 |

OTHER PUBLICATIONS

International Preliminary Report on Patentability for International Application No. PCT/ JP2013/003199 mailed Nov. 25, 2014.
Written Opinion of the International Searching Authority for International Application No. PCT/ JP2013/003199 mailed Aug. 6, 2013.
International Search Report for International Application No. PCT/ JP2013/003199 mailed Aug. 6, 2013.

* cited by examiner

CONTINUOUS ANNEALING FURNACE FOR STEEL STRIP, CONTINUOUS ANNEALING METHOD, CONTINUOUS GALVANIZING APPARATUS AND METHOD FOR MANUFACTURING GALVANIZED STEEL STRIP (AS AMENDED)

CROSS REFERENCE TO RELATED APPLICATIONS

This is the U.S. National Phase application of PCT/JP2013/003199, filed May 20, 2013, which claims priority to Japanese Patent Application No. 2012-118116, filed May 24, 2012, the disclosures of each of these applications being incorporated herein by reference in their entireties for all purposes.

FIELD OF THE INVENTION

The present invention relates to a continuous annealing furnace for a steel strip, a continuous annealing method, a continuous galvanizing apparatus and a method for manufacturing a galvanized steel strip.

BACKGROUND OF THE INVENTION

In the past, in the case of a continuous annealing furnace for annealing a steel strip, for example, when operation is resumed after the furnace has been exposed to atmospheric air or when atmospheric air is mixed in a furnace atmosphere, a method for replacing the furnace atmosphere with a non-oxidizing gas, in which a non-oxidizing gas such as an inert gas is fed into the furnace as a replacing gas for the furnace atmosphere at the same time as the gas in the furnace is discharged while moisture in the furnace is vaporized by increasing a furnace temperature, has been widely used in order to decrease moisture and oxygen concentration in the furnace.

However, in the case of such a conventional method, since it takes a long time to decrease moisture content and oxygen concentration of the furnace atmosphere to specified levels which are appropriate for a regular operation, and since the furnace cannot be operated during all that time, there is a problem in that there is a significant decrease in productivity.

In addition, nowadays, in the fields of, for example, automobile, domestic electric appliance, and building material industries, there is an increasing demand for high-strength steel (high-tension material) capable of contributing to the weight reduction and the like of structural materials. In the case of a technique using this high-tension material, it is indicated that it is possible to manufacture a high-strength steel strip excellent in terms of stretch flangeability by adding Si in steel. In addition, in the case of technique using this high-tension material, it is indicated that it is possible to provide a steel strip excellent in terms of ductility owing to a tendency for a retained γ phase to be formed by containing Si and Al.

However, in the case of a high-strength cold-rolled steel strip containing easily oxidized chemical elements such as Si and Mn, there is a problem in that these easily oxidized chemical elements are concentrated in the surface of the steel strip during annealing and oxides of, for example, Si and Mn are formed, which results in surface appearance defects or defects in a chemical conversion treatment such as a phosphating treatment.

In the case of a galvanized steel strip, when it contains easily oxidized chemical elements such as Si and Mn, there is a problem in that these easily oxidized chemical elements are concentrated in the surface of the steel strip during annealing and oxides of, for example, Si and Mn are formed, which results in coating defects due to a decrease in zinc coatability or results in a decrease in alloying speed at the time when an alloying treatment is performed after a plating treatment has been performed. In particular, in the case Si, when an oxide film of $SiO_2$ is formed on the surface of a steel strip, Si causes a significant decrease in wettability between the steel strip and molten plating metal, and the oxide film of $SiO_2$ becomes a barrier to diffusion between the base steel and plating metal when an alloying treatment is performed. Therefore, Si particularly tends to cause problems by decreasing zinc coatability and alloying treatment performance.

As a method for preventing these problems, consideration is given to controlling the oxygen potential in an annealing atmosphere.

Patent Literature 1 discloses an example of a method for increasing the oxygen potential in which the dew point of the latter part of a heating zone and a soaking zone is controlled to be high, that is, −30° C. or higher. This method can be expected to be effective to some extent and has an advantage that the dew point can be controlled to be high in an easy industrial manner. However, this method has a disadvantage that, with this method, it is not easy to manufacture some steel grades (such as Ti-based IF steel) for which an operation in an atmosphere having a high dew point is not desirable. This is because it takes a very long time to control the dew point of an annealing atmosphere to be low once the dew point has been controlled to be high. In addition, since an oxidizing furnace atmosphere is used in this method, there is a problem in that there are pickup defects due to oxides sticking to rolls in the furnace and there is a problem in that there is furnace wall damage in the case where there is a control error.

As another method, consideration is given to controlling the oxygen potential to be low. However, in the case of a large-scale continuous annealing furnace which is installed in a CGL (continuous galvanizing line) or a CAL (continuous annealing line), since Si, Mn and the like are significantly easily oxidized, it has been thought that it is very difficult to control the dew point of the atmosphere to be normally low so that there is a good effect for preventing Si, Mn, and the like from being oxidized, that is, −40° C. or lower.

Techniques with which an annealing atmosphere having a low dew point can be efficiently achieved are disclosed by, for example, Patent Literature 2 and Patent Literature 3. Since these techniques are intended for comparatively small-scale furnaces of a one-pass vertical type, no consideration is given to an application to furnaces of a multi-pass vertical type such as a CGL and a CAL. Therefore, there is significantly high risk with using these techniques in that it may be impossible to efficiently decrease the dew point.

PATENT LITERATURE

[PTL 1] WO2007/043273
[PTL 2] Japanese Patent No. 2567140
[PTL 3] Japanese Patent No. 2567130

SUMMARY OF THE INVENTION

A problem to be solved by the present invention is to provide a continuous annealing furnace for a steel strip with which the dew point of the furnace atmosphere can be rapidly decreased to a level appropriate for a regular operation before performing a regular operation in which a steel strip is subjected to a continuous heat treatment or when there is an increase in moisture concentration and/or oxygen concentration in the furnace atmosphere during a regular operation. In addition, a problem to be solved by the present invention is to provide a continuous annealing furnace for a steel strip suitable for annealing a steel strip containing easily oxidized chemical elements such as Si with which it is possible to stably achieve an atmosphere having a low dew point in which problems of pickup defects and furnace wall damage are less likely to occur and with which it is possible to prevent easily oxidized chemical elements such as Si and Mn in steel from being concentrated in the surface of a steel strip and forming oxides of easily oxidized chemical elements such as Si and Mn when annealing is performed. In addition, a problem to be solved by the present invention is to provide a method for continuous annealing of a steel strip using the continuous annealing furnace.

In addition, a problem to be solved by the present invention is to provide a continuous galvanizing apparatus having the continuous annealing furnace. In addition, a problem to be solved by the present invention is to provide a method for manufacturing a galvanized steel strip including continuously annealing a steel strip using the method for annealing and then galvanizing the annealed steel strip.

Here, the present invention includes a technique which is applied to an annealing furnace having a dividing wall which physically separates the heating zone and soaking zone of the annealing furnace.

The present inventors determined dew point distributions in a large-scale furnace of a multi-pass vertical type and conducted a flow analysis or the like using the determined distributions. As a result, the present inventors found the following findings.

1) Since water vapor ($H_2O$) has a smaller specific weight than $N_2$ gas which constitutes a large portion of the atmosphere, the dew point tends to become high in the upper part of a furnace in the case of an annealing furnace of a multi-pass vertical type.

2) By suctioning a furnace gas from the upper part of the furnace into a refiner having a deoxidation device and a dehumidification device in order to decrease the dew point of the gas by removing oxygen and moisture from the gas, and by returning the gas having a decreased dew point into the specified part of the furnace, it is possible to prevent the dew point from becoming high in the upper part of the furnace and to decrease the dew point of the furnace atmosphere to a specified level which is appropriate for a regular operation in a short time.

3) In the case where the furnace gas is also suctioned into the refiner from parts other than the upper part of the furnace, it is necessary that the inlet of the gas be not placed at a position in the vicinity of the steel strip entrance in the lower part of a heating zone.

The present inventors found that, with the method described above, it is possible to stably achieve a furnace atmosphere having a low dew point in which problems of pickup defects and furnace wall damage are less likely to occur and in which it is possible to prevent easily oxidized chemical elements such as Si and Mn in steel from being concentrated in the surface of a steel strip and forming oxides of easily oxidized chemical elements such as Si and Mn when annealing is performed.

The method according to an embodiment of the present invention for solving the problems described above is as follows.

(1) A continuous annealing furnace for a steel strip, the furnace being a vertical annealing furnace including a heating zone, a soaking zone, and a cooling zone located in this order through which a steel strip is transferred in the up-and-down direction, the connection part between the soaking zone and the cooling zone being located in the upper part of the furnace, the heating zone and the soaking zone being communicated with each other in the upper part of the furnace, a dividing wall being placed in a part of the furnace other than the communicated parts in the upper part of the furnace to physically separate the heating zone and the soaking zone, an atmospheric gas being fed into the furnace from the outside of the furnace, and the furnace gas being discharged through a steel strip entrance in the lower part of the heating zone while a refiner having a deoxidation device and a dehumidification device which is placed outside the furnace such that part of the furnace gas is suctioned into the refiner to decrease the dew point of the gas by removing oxygen and moisture from the gas and the resultant gas having a decreased dew point is returned into the furnace through a gas delivery port, in which a gas suction port from the furnace into the refiner is located in the lower part of the connection part between the soaking zone and the cooling zone and in which one or more gas suction ports are located in the parts of the heating zone and/or the soaking zone outside of an area within 6 m in the vertical direction and 3 m in the longitudinal direction of the furnace from the steel strip entrance in the lower part of the heating zone.

(2) The continuous annealing furnace for a steel strip according to item (1), the furnace further including a dew point sensing stations of a dew point meter for determining the dew point of the furnace gas located in the vicinity of gas suction ports located in the heating zone and the soaking zone.

(3) The continuous annealing furnace for a steel strip according to item (1) or (2), the furnace further including plural gas delivery ports, the gas flowing from the refiner to the furnace through the gas delivery ports, that are located in the connection part between the soaking zone and the cooling zone and the upper part of the heating zone, in which the delivery width W0 of the gas delivery ports located in the upper part of the heating zone satisfies the relationship with the furnace width W of the heating zone that W0/W is larger than ¼, where the delivery width W0 of the gas delivery ports in the heating zone is the distance in the longitudinal direction of the furnace between the gas delivery port located at a position nearest to the entrance of the heating zone and the gas delivery port located at a position nearest to the exit of the heating zone.

(4) A method for continuously annealing a steel strip, the method including continuously annealing a steel strip using the continuous annealing furnace for a steel strip according to item (2) or (3), determining the dew point of the furnace gas in the vicinity of the gas suction ports in the heating zone and the soaking zone, preferentially suctioning the furnace gas at positions where the dew point is high and preferentially delivering the gas returned from the refiner through the gas delivery ports placed in the upper part of the heating zone.

(5) The method for continuously annealing a steel strip according to item (4), in which the delivery width W1 of a gas delivered from the upper part of the heating zone satisfying the relationship with the furnace width W of the heating zone that W1/W is larger than ¼, where the delivery width W1 of the gas delivery ports is a distance in the longitudinal direction of the furnace between the gas delivery port delivering the gas from the position nearest to the entrance of the heating zone and the gas delivery port delivering the gas from the position nearest to the exit of the heating zone.

(6) A continuous galvanizing apparatus for a steel strip, the apparatus including a galvanizing apparatus installed downstream of the annealing furnace according to any one of items (1) to (3).

(7) A method for manufacturing a galvanized steel strip, the method further including performing galvanization after performing the continuous annealing of a steel strip using the method according to item (4) or (5).

According to the present invention, it is possible to decrease the time until the dew point of the furnace atmosphere is decreased to −30° C. or lower so that manufacturing of steel strip can be stably performed by decreasing moisture concentration and/or oxygen concentration in a furnace atmosphere before performing a regular operation in which a steel strip is subjected to a continuous heat treatment or when there is an increase in moisture concentration and/or oxygen concentration in the furnace atmosphere during a regular operation, which can prevent the productivity from being lowered.

In addition, according to the present invention, it is possible to stably achieve a furnace atmosphere having a low dew point of −40° C. or lower in which problems of pickup defects and furnace wall damage are less likely to occur and in which it is possible to prevent easily oxidized chemical elements such as Si and Mn in steel from being concentrated in the surface of a steel strip and forming oxides of easily oxidized chemical elements such as Si and Mn when annealing is performed. In addition, according to the present invention, it is possible to easily manufacture some steel grades such as Ti-based IF steel for which an operation in an atmosphere having a high dew point is not desirable.

DETAILED DESCRIPTION OF EMBODIMENTS OF THE INVENTION

Figure 1:
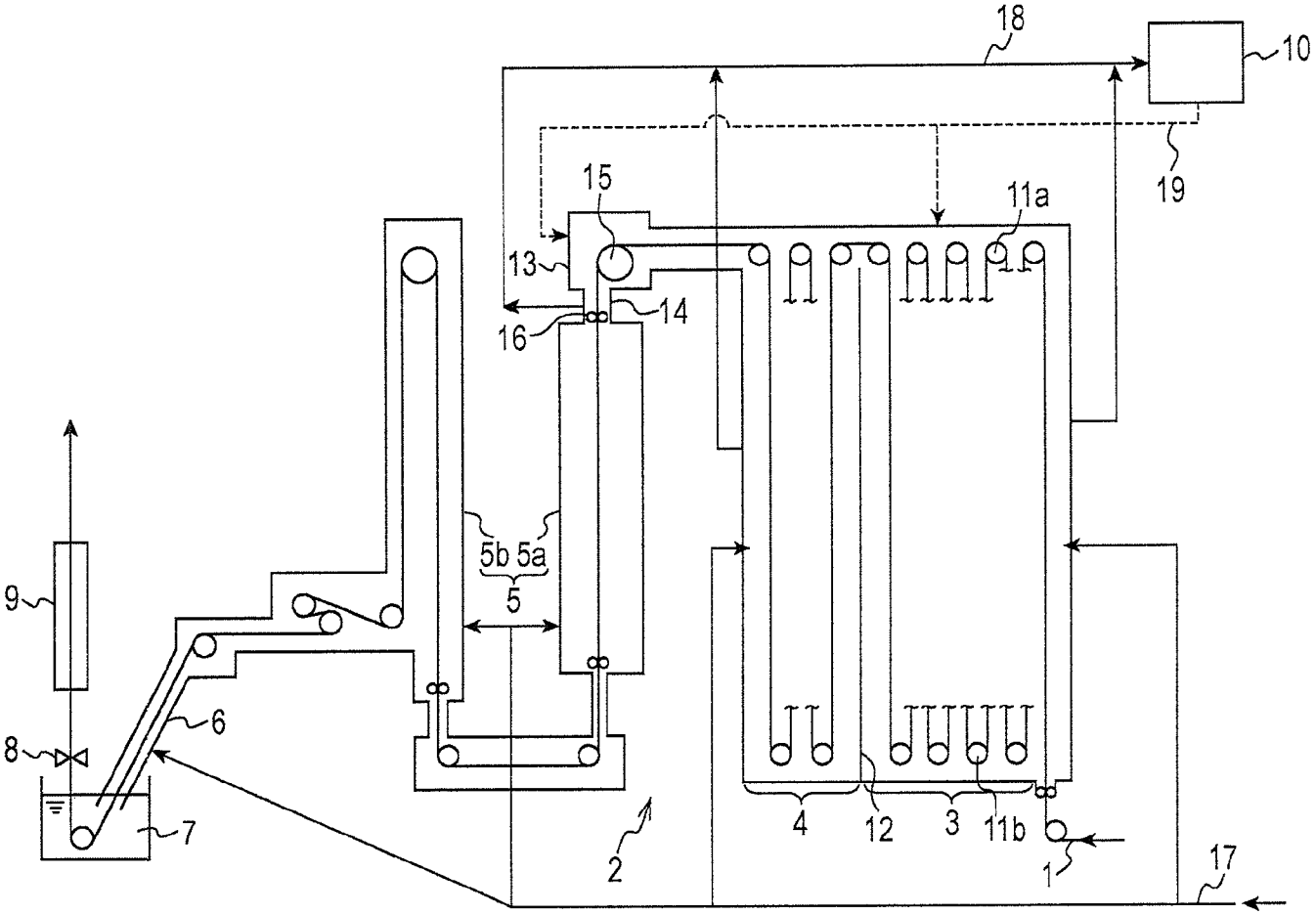
FIG. 1 is a diagram illustrating one configuration example of a continuous galvanizing line having a continuous annealing furnace for a steel strip according to an embodiment of the present invention.

In a continuous galvanizing line for steel strip, an annealing furnace is placed upstream of a galvanizing bath. Usually, the annealing furnace includes a heating zone, a soaking zone, and a cooling zone arranged in this order from the upstream side to the downstream side of the furnace. There is a case where a pre-heating zone is placed upstream of the heating zone. The annealing furnace and the galvanizing bath are connected through a snout, and a reducing atmospheric gas or a non-oxidizing atmosphere is present in the furnace from the heating zone through the snout. In the heating zone and the soaking zone, a steel strip is indirectly heated by radiant tubes (RT) serving as heating means. As a reducing atmospheric gas, $H_2$—$N_2$ gas is usually used and fed into appropriate parts inside the furnace from the heating zone through the snout. In this line, a steel strip is heated and annealed at a specified temperature in the heating zone and the soaking zone, cooled in the cooling zone, dipped in the galvanizing bath through the snout and then galvanized, and optionally, further, an alloying treatment is performed on the galvanized layer.

In a continuous galvanizing line, the furnace is connected with the galvanizing bath through the snout. Therefore, since a gas which is fed into the furnace other than some of the gas, for example, inevitable leak gas that is leaked out through the furnace body, is discharged through the entrance of the furnace, the gas flows from the downstream side to the upstream side in the furnace in a direction opposite to the traveling direction of a steel strip. In addition, since water vapor ($H_2O$) has a smaller specific weight than $N_2$ gas which constitutes a large portion of the atmosphere, the dew point tends to become high in the upper part of a furnace in the case of an annealing furnace of a multi-pass vertical type.

In order to efficiently decrease the dew point, it is important to prevent dew point of the atmospheric gas in the upper part from being increased without the occurrence of stagnation of the furnace atmospheric gas (stagnation of the atmospheric gas in the upper part, middle part, and lower part of the furnace). Also, in order to efficiently decrease the dew point, it is important to find the generation source of moisture which causes an increase in dew point. Examples of the generation source of moisture include outside air flowing in through the furnace wall, the steel strip, and the furnace entrance and moisture flowing in from the cooling zone and the snout, and, in addition to that, in the case where there are leaking spots in RT or the furnace wall, the spots may also become the generation source of moisture.

The higher the steel strip temperature is, the influence of the dew point on zinc coatability becomes larger and, in particular, the influence becomes large in a temperature range of 700° C. or higher in terms of steel strip temperature in which there is an increase in affinity for oxygen. Therefore, the dew point in the latter part of the heating zone and the soaking zone in which there is an increase in temperature has a large influence on zinc coatability. In the case where there is a dividing wall which physically separates the heating zone and the soaking zone, it is necessary that the dew point be efficiently controlled to be low in each of the heating zone and the soaking zone.

Specifically, it is necessary that it be possible to decrease the time until the dew point of the furnace atmosphere is entirely decreased to −30° C. or lower so that manufacturing of steel strip can be stably performed by decreasing moisture concentration and/or oxygen concentration in a furnace atmosphere before performing a regular operation in which a steel strip is subjected to a continuous heat treatment or when there is an increase in moisture concentration and/or oxygen concentration in the furnace atmosphere during a regular operation.

In addition, it is necessary to decrease the dew point to −40° C. or lower so that there is a good effect for preventing Si and Mn and the like from being oxidized, and it is also necessary to decrease the dew point in both the heating zone and the soaking zone in the case of an annealing furnace having a dividing wall which physically separates the heating zone and the soaking zone. Since it is advantageous that the dew point be as low as possible from the viewpoint of zinc coatability, it is preferable that it be possible to decrease the dew point to −45° C. or lower, more preferably −50° C. or lower.

In an embodiment of the present invention, in order to decrease the dew point, of an atmospheric gas, part of the atmospheric gas in the furnace is charged into a refiner having a deoxidation device and a dehumidification device which is placed outside the furnace in order to remove oxygen and moisture from the gas and to decrease the dew point, and the gas having a decreased dew point is returned into the furnace. At this time, in an embodiment of the present invention, suction ports through which the furnace gas is charged into the refiner and gas delivery ports through which the gas having a decreased dew point is returned from the refiner into the furnace are located in a Manner described in items 1) to 3) below.

1) Since a gas having a high dew point coming from the plating pot side is mixed into the upper part of the cooling zone, and, in order to prevent outside air from flowing in through the cooling zone and a snout, it is necessary to prevent stagnation of the atmospheric gas in the upper part of the cooling zone. In order to prevent stagnation of the atmospheric gas in the part described above, a suction port through which the gas is charged into the refiner is located in the lower part of the connection part between the soaking zone and the cooling zone. It is preferable that the gas suction port be located at a position where a flow channel is narrow such as at a throat part or a position in the vicinity of seal rolls in the lower part of the connection part between the soaking zone and the cooling zone. However, it is preferable that the gas suction port be located within 4 m from a cooling device (cooling nozzles) in the cooling zone, more preferably within 2 m. This is because, in the case where the distance from the cooling device is excessively large, since a steel sheet is exposed for a long time to a gas having a high dew point before cooling is started, there is concern that easily oxidized chemical elements such as Si and Mn may be concentrated in the surface of the steel sheet. With this gas suction, although stagnation of the gas in the upper part of the cooling zone can be prevented, there is concern that the furnace pressure in the vicinity of the gas suction port may become negative pressure. Therefore, it is preferable that a gas delivery port through which gas is returned from the refiner be located in the connection part between the soaking zone and the cooling zone. It is preferable that the gas delivery port be located at a position higher than the pass-line of the connection part between the soaking zone and the cooling zone. It is more preferable that the gas delivery port be located at a position which is higher than the pass-line and which is on the furnace wall side on the exit side of a roll which changes the traveling direction of a steel strip which comes out of the soaking zone to the downward direction. It is preferable that the gas suction port and the gas delivery port be arranged with a distance between them of 2 m or more. This is because, in the case where the positions of the gas suction port and the gas delivery port are excessively near, since there is a decrease in the fraction of a gas having a high dew point suctioned through the suction port (there is an increase in the fraction of a gas delivered through the gas delivery port), there is a decrease in the efficiency of removing moisture.

2) It is ideal that a furnace gas suction port be located at a position where the dew point is the highest. In the case where there is a dividing wall between the heating zone and the soaking zone, the dew point distribution varies widely depending on which side of the dividing wall, that is, upstream or downstream of the dividing wall, a main generation source of moisture is located. For example, in the case where there is a main generation source of moisture at a position in the heating zone in the former part of the annealing furnace such as the furnace entrance side, since the dew point becomes high in the heating zone, it is necessary that a gas suction port be located in the heating zone. On the contrary, in the case where there is a main generation source of moisture in the soaking zone in the latter part of the annealing furnace, since the dew point becomes high in the soaking zone, it is necessary that a gas suction port be located in the soaking zone. In the case where it is impossible to determine which of the heating zone and the soaking zone the dew point becomes high, it is necessary that at least one gas suction port be placed in each of both the heating zone and the soaking zone. By placing gas suction ports in a manner described above, a significant increase in the dehumidification capacity of the refiner can be achieved. Here, gas suction ports in the heating zone should be located in an area other than that within 6 m in the vertical direction and 3 m in the longitudinal direction of the furnace from the steel strip entrance in the lower part of the heating zone. This is because, in the case where gas suction ports are located in an area within 6 m in the vertical direction and 3 m in the longitudinal direction of the furnace from the steel strip entrance in the lower part of the heating zone, since there is an increase in the probability of a gas outside the furnace being taken into the furnace, there is concern that there may be an increase in the dew point.

3) Since there is almost no flow of the furnace gas in the upper part of the heating zone due to the structure of the heating zone, stagnation of the atmospheric gas tends to occur. Therefore, since the dew point tends to become high in this part, it is preferable to locate gas delivery ports through which the gas is returned from the refiner in the upper part of the heating zone. Since it is advantageous that the gas delivery ports be located at as high a position as possible in the heating zone in order to eliminate stagnation, it is more preferable that the gas delivery ports be located in an area (area higher than vertical position −2 m) at least higher than a reference position which is located 2 m lower than the vertical position of the center of the upper hearth rolls in the heating zone.

In order to prevent gas stagnation in the heating zone, it is preferable that gas delivery ports be located at two or more positions. In this case, in order to increase an effect of preventing gas stagnation in the heating zone, it is preferable that the gas delivery ports be located so that the delivery width W0 of the gas delivery ports in the heating zone satisfies the relationship with the furnace width W that W0/W is larger than ¼. Here, the delivery width W0 of the gas delivery ports in the heating zone is the distance in the longitudinal direction of the furnace between the gas delivery port located at a position nearest to the entrance of the heating zone and the gas delivery port located at a position nearest to the exit of the heating zone (distance between the centers of the gas delivery ports).

The present invention has been completed on the basis of the viewpoints described above.

The embodiments of the present invention will be described using FIGS. 1 through 3 hereafter.

FIG. 1 illustrates one configuration example of a continuous galvanizing line for a steel strip having a vertical annealing furnace used in the embodiment of the present invention.

In FIG. 1, reference numeral 1 denotes a steel strip and reference numeral 2 denotes an annealing furnace, and the annealing furnace 2 includes a heating zone 3, a soaking zone 4, and a cooling zone 5 in this order in the traveling direction of the steel strip. In the heating zone 3 and the soaking zone 4, plural upper hearth rolls 11*a* and lower hearth rolls 11*b* are located and form plural passes through which the steel strip 1 is transferred in multiple times in the up-and-down direction. In the heating zone 3 and the soaking zone 4, the steel strip 1 is indirectly heated by RT as heating means. Reference numeral 6 denotes a snout, reference numeral 7 denotes a galvanizing bath, reference numeral 8 denotes a gas wiping nozzle, reference numeral 9 denotes a heating apparatus for performing an alloying treatment and reference numeral 10 denotes a refiner for performing deoxidation and dehumidification on an atmospheric gas suctioned from the furnace.

The heating zone 3 and the soaking zone 4 are connected and communicated with each other in the upper part of the furnace. A dividing wall 12, which separates the atmospheric gases in the heating zone 3 and the soaking zone 4, is placed in a part of the furnace other than the communicated parts in the upper part of the furnace. The dividing wall 12 is vertically placed at an intermediate position in the longitudinal direction of the furnace between the upper hearth roll at the exit of the heating zone 3 and the upper hearth roll at the entrance of the soaking zone 4 so that the upper edge of the wall is close to the steel strip 1 and the lower edge thereof and the edges thereof in the width direction of the steel strip are in contact with the furnace walls.

A connection part 13 between the soaking zone 4 and the cooling zone 5 is located in the upper part of the furnace above the cooling zone 5, and, in the connection part 13, a roll 15, which changes the traveling direction of the steel strip 1 which comes out of the soaking zone 4 to the downward direction, is placed. In order to prevent the atmosphere of the soaking zone 4 from flowing into the cooling zone 5 and to prevent the radiation heat of the furnace walls of the connection part from entering the cooling zone 5, the exit on the cooling zone 5 side at a lower part of the connection part is in the form of a throat (a structure having a decreased area of a cross section through which the steel strip travels, namely, throat part), and seal rolls 16 are placed in the throat part 14.

The cooling zone 5 consists of a first cooling zone 5*a* and a second cooling zone 5*b*, and there is only one pass of the steel strip travelling in the first cooling zone 5*a*.

In FIG. 1, reference numeral 17 denotes an atmospheric gas feeding system through which an atmospheric gas is fed from the outside of the furnace into the furnace, reference numeral 18 denotes a gas charging pipe for charging a gas into the refiner 10 and reference numeral 19 denotes a gas discharging pipe for discharging a gas from the refiner 10.

Using valves (not illustrated) and flowmeters (not illustrated) which are placed in the middle of pipe lines of the atmospheric gas feeding system 17 which are connected to various zones and areas, it is possible to individually control the amounts of the atmospheric gas, or stop supplying the atmospheric gas, which is fed into each of various zones and areas such as the heating zone 3, the soaking zone 4, the cooling zone 5, and downstream zones of the cooling zone 5 in the furnace. Usually, in order to reduce oxides which are present on the surface of a steel strip and to prevent atmospheric gas cost from becoming excessively large, a gas having chemical composition of $H_2$: 1 to 10 vol % and the balance being $N_2$ and inevitable impurities is used as an atmospheric gas which is fed into the furnace. The dew point of the gas is about −60° C.

Suction ports through which a furnace gas is charged into the refiner are located in the lower part of the connection part 13 between the soaking zone 4 and the cooling zone 5 and in the part of the heating zone 3 and/or the soaking zone 4 outside of an area (see FIG. 2) within 6 m in the vertical direction and 3 m in the longitudinal direction of the furnace from the steel strip entrance in the lower part of the heating zone 3. It is preferable that suction ports which are located in the heating zone 3 and the soaking zone 4 be located at plural positions respectively. In the case where seal rolls are located in the throat part 14, since a gas flow channel is further narrower at the position of the seal rolls, it is more preferable that a gas suction port is located at this position or in the vicinity of this position.

It is preferable that gas delivery ports through which a gas having the dew point decreased in the refiner is delivered into the furnace be located in the connection part between the soaking zone and the cooling zone and in the upper part of the heating zone. It is more preferable that a gas delivery port which is located in the connection part between the soaking zone and the cooling zone be located at a position higher than the pass line of the connection part 13 between the soaking zone 4 and the cooling zone 5. It is further preferable that a gas delivery ports which is located in the connection part between the soaking zone and the cooling zone be located at a position which is higher than the pass line and which is on the furnace wall side on the exit side with respect to the roll 15 which changes the traveling direction of a steel strip in the connection part to the downward direction. It is more preferable that gas delivery ports which are located in the upper part of the heating zone 3 be located in an area higher than the position which is located 2 m lower than the vertical position of the center of upper hearth rolls in the heating zone 3. It is preferable that gas delivery ports in the heating zone be located at plural positions.

Figure 2:
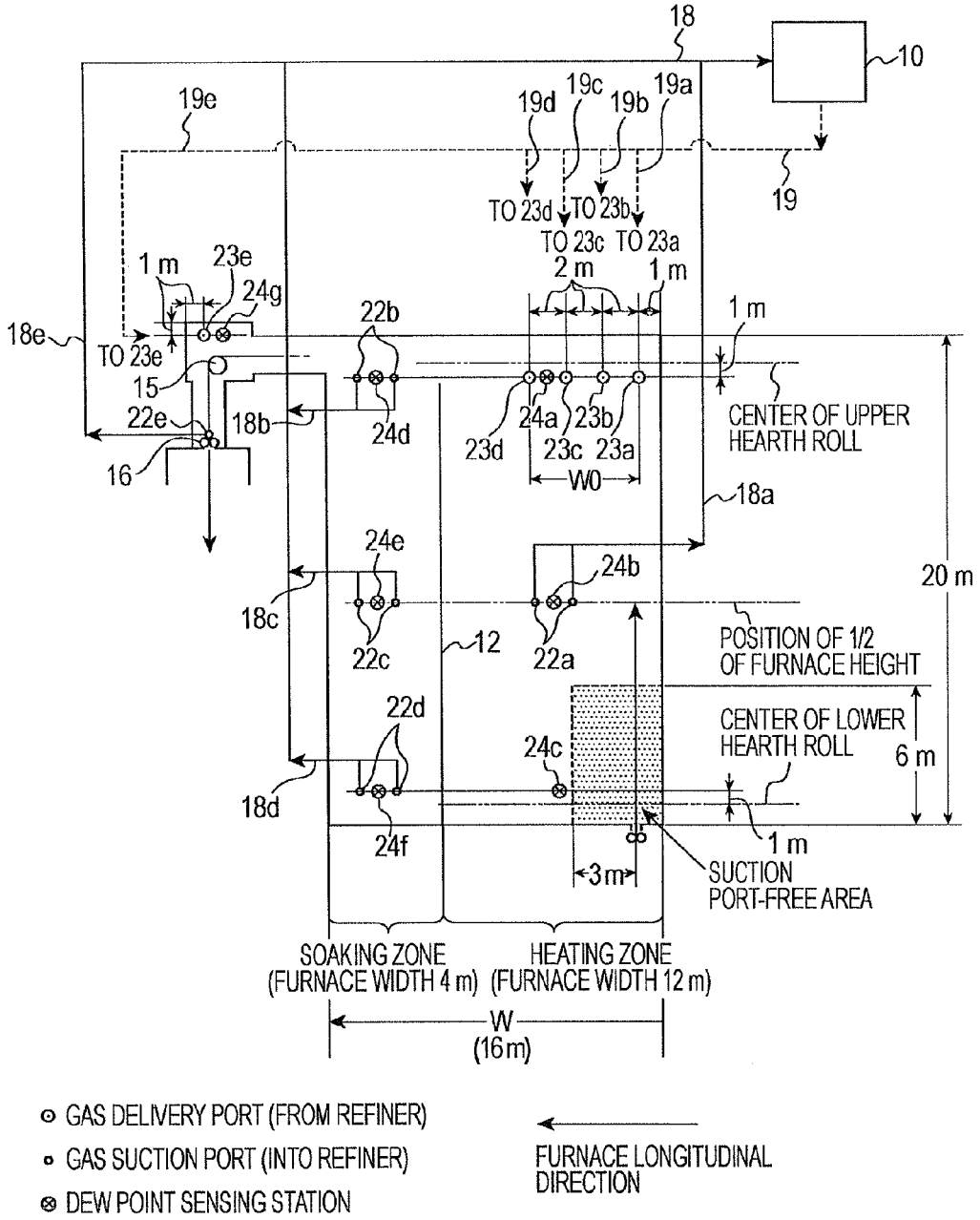
FIG. 2 is a diagram illustrating one location example of gas suction ports into a refiner, gas delivery ports from the refiner and dew point sensing stations.

FIG. 2 illustrates a location example of gas suction ports into a refiner 10, gas delivery ports from the refiner 10 and dew point sensing stations. Reference numerals 22*a* through 22*e* denote gas suction ports, reference numerals 23*a* through 23*e* denote gas delivery ports and reference numerals 24*a* through 24*g* denote dew point sensing stations. The furnace width (W) of the heating zone is 12 m and the furnace width of the soaking zone is 4 m, and the total furnace width of the heating zone and the soaking zone is 16 m.

The diameter of a gas suction port is ϕ200 mm. Among gas suction ports, one (22*e*) is separately located in the throat part in the lower part of the connection part 13 between the soaking zone 3 and the cooling zone 4. Moreover, four groups of suction ports (22*a* through 22*d*) in total are respectively located at a position 1 m lower than the center of the upper hearth rolls in the soaking zone (22*b*), at a position of ½ of the furnace height of the soaking zone (central position in the height direction: 22*c*), at a position 1 m higher than the center of the lower hearth rolls in the soaking zone (22*d*) and at the center of the heating zone (at a position of ½ of the furnace height and the center in the longitudinal direction of the furnace: 22*a*), where one group consists of a pair of suction ports which are separated by 1 m in the longitudinal direction of the furnace.

The diameter of a gas delivery port is ϕ50 mm. Among gas delivery ports, one (23*e*) is separately located at a position of 1 m from the furnace wall on the exit side of the connection part between the soaking zone and the cooling zone and 1 m from the ceiling. Moreover, 4 gas delivery ports (23*a* through 23*d*) are located at positions 1 m lower than the center of the hearth rolls in the upper part of the heating zone at intervals of 2 m in the longitudinal direction of the furnace starting at a position of 1 m from the furnace wall on the entrance side of the heating zone. In FIG. 2, the delivery width W0 of the gas delivery ports in the upper part of the heating zone is 6 m. The ratio of the width of the gas delivery ports W0 to the furnace width W (=12 m) W0/W is equal to ½, which satisfies the condition that W0/W is larger than ¼. Here, the delivery width W0 of the gas delivery ports in the heating zone is the distance in the longitudinal direction of the furnace between the gas delivery port located at a position nearest to the entrance of the heating zone and the gas delivery port located at a position nearest to the exit of the heating zone.

Dew point sensing stations of dew point meters for detecting the dew point of the furnace gas are respectively located in the connection part between the soaking zone and the cooling zone (24*g*), at an intermediate position between the 2 suction ports of each of the suction port groups located in the soaking zone and the heating zone (24*b* and 24*d* through 24*f*), at an intermediate position between the third and fourth gas delivery ports from the entrance side of the heating zone (intermediate position between gas delivery ports 23*c* and 23*d*: 24*a*) and at a position 1 m higher than the center of the lower hearth rolls in the heating zone and of 6 m from the furnace wall on the entrance side (24*c*).

While the gas is always suctioned through the suction port located in the throat part in the lower part of the connection part between the soaking zone and the cooling zone, among suction ports located in the soaking zone and the heating zone, suction ports through which the gas is suctioned can be selected on the basis of the dew point data corresponding to the suction positions.

The reason why plural atmospheric gas suction ports are located in the heating zone and the soaking zone respectively will be described hereafter.

In the case where there is a dividing wall between the heating zone and the soaking zone, the dew point distribution varies widely depending on which side of the dividing wall, that is, upstream or downstream in the travelling direction of a steel strip, a generation source of moisture is located. For example, in the case where there is a generation source of moisture in the vicinity of the entrance side of the furnace, while the dew point generally tends to be high at every point on the entrance side of the furnace from the dividing wall, the dew point tends to be low in the exit side of the furnace. Therefore, by suctioning the gas on the entrance side of the furnace, there is an increase in efficiency of dehumidification. However, in the case where there is a generation source of moisture on the exit side of the furnace, by suctioning the gas on the entrance side of the furnace, there is a decrease in efficiency of dehumidification. Therefore, in order to increase an efficiency of dehumidification even when the position where there is a generation source of moisture changes, it is necessary that suction ports be located on both sides of the dividing wall.

The atmospheric gas which is suctioned through the suction ports can be charged into the refiner through gas charging pipes 18*a* through 18*e* and 18. By using valves (not illustrated) and flowmeters (not illustrated) which are placed in the middle of the gas charging pipes 18*a* through 18*e*, it is possible to separately control the amounts of the atmospheric gas, or stop the atmospheric gas, which is suctioned from the furnace through the individual suction ports.

Figure 3:
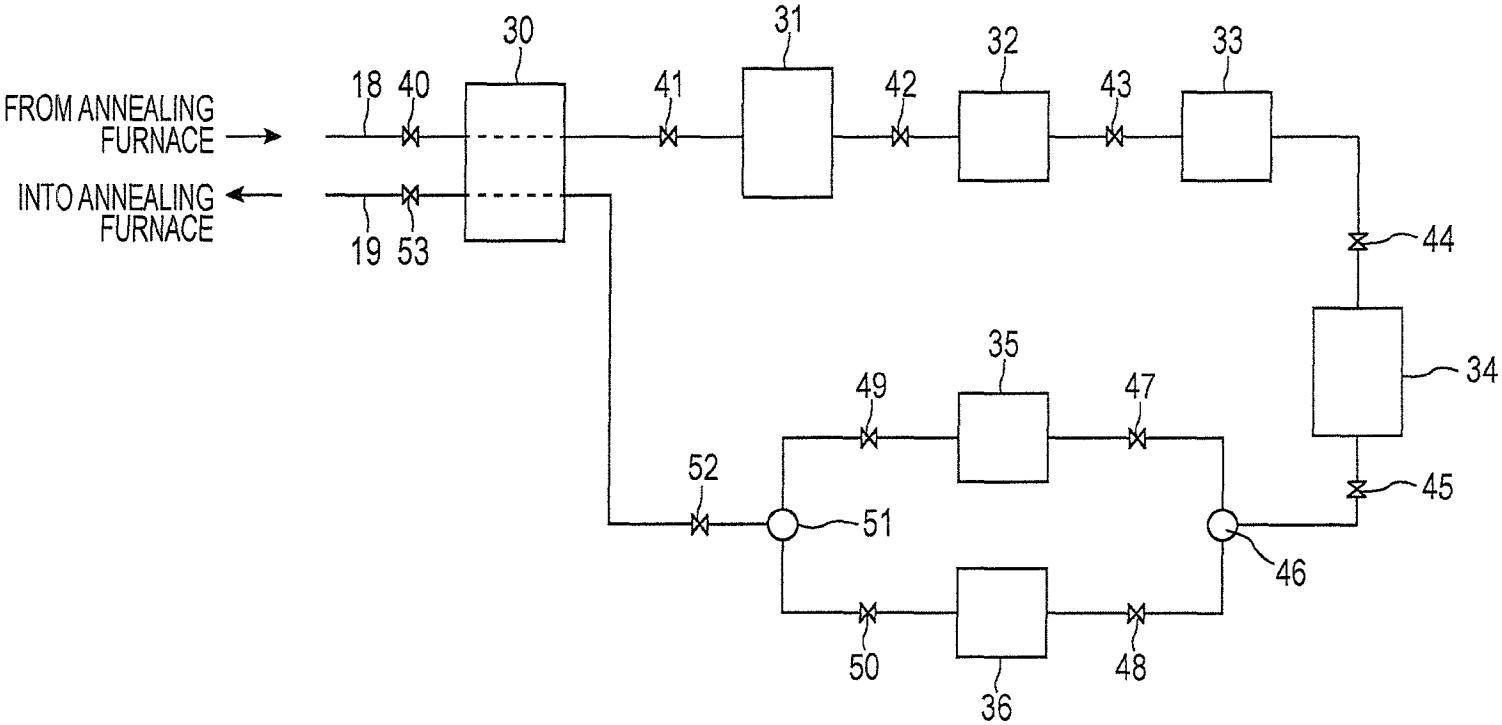
FIG. 3 is a diagram illustrating one configuration example of a refiner.

FIG. 3 illustrates a configuration example of a refiner 10. In FIG. 3, reference numeral 30 denotes a heat exchanger, reference numeral 31 denotes a cooler, reference numeral 32 denotes a filter, reference numeral 33 denotes a blower, reference numeral 34 denotes a deoxidation device, reference numerals 35 and 36 denote dehumidification devices, reference numerals 46 and 51 denote switching valves and reference numerals 40 through 45, 47 through 50, 52 and 53 denote valves. The deoxidation device 34 is a deoxidation device using a palladium catalyst. The dehumidification devices 35 and 36 are dehumidification devices using a synthesis zeolite catalyst. In order to perform a continuous operation, two dehumidification devices 35 and 36 are located in parallel with each other.

The gas from which oxygen and moisture have been removed by the refiner and which has the decreased dew point can be delivered into the furnace through the discharging pipes 19 and 19*a* through 19*e* and further through the gas delivery ports 23*a* through 23*e*. By using valves (not illustrated) and flowmeters (not illustrated) which are placed in the middle of the gas discharging pipes 19*a* through 19*e*, it is possible to separately control the amounts of the gas, or stop the gas, which is delivered into the furnace through the individual gas delivery ports.

At this time, by delivering the gas so that the delivery width W1 of the gas delivered from the upper part of the heating zone satisfies the relationship with the furnace width W of the heating zone that W1/W is larger than ¼, there is a further increase in effect of preventing an increase in dew point due to stagnation of the atmospheric gas in the upper part of the heating zone. Here, the delivery width W1 of the gas delivery ports is the distance in the longitudinal direction of the furnace between the gas delivery port delivering the gas from the position nearest to the entrance of the heating zone and the gas delivery port delivering the gas from the position nearest to the exit of the heating zone.

A method for annealing and then galvanizing a steel strip using this continuous galvanizing line will be described hereafter. Firstly, by transferring the steel strip 1 through the heating zone 3, and the soaking zone 4, the steel strip is heated and annealed at a specified temperature (for example, about 800° C.) and then cooled down to a specified temperature in the cooling zone 5. After the cooling has been performed, the steel strip 1 is dipped in the galvanizing bath 7 through the snout 6 and galvanized, and then pulled up from the galvanizing bath in order to control coating weight to be a specified value using the gas wiping nozzles 8 which are placed above the galvanizing bath. After coating weight has been controlled, an alloying treatment is performed as needed using the heating apparatus 9 which is placed above the gas wiping nozzles 8.

At this time, an atmospheric gas is fed into the furnace from the atmospheric gas feeding system 17. Common kind, composition and feeding method of the atmospheric gas may be used. Usually, $H_2$—$N_2$ gas is used and fed into the heating zone 3, soaking zone 4, the cooling zone 5 and various parts located downstream of the cooling zone in the furnace.

In addition, the atmospheric gas in the heating zone 3, the soaking zone 4 and the throat part 14 which is located in the lower part of the connection part 13 between the soaking zone 4 and the cooling zone 5 is suctioned through the gas suction ports 22*a* through 22*e* using a blower 33. By letting the suctioned gas flow through the heat exchanger 30 and the cooler 31 in this order in order to cool the atmospheric gas down to a temperature of about 40° C. or lower, by cleaning the cooled gas using the filter 32, by performing deoxidation on the cleaned atmospheric gas using the deoxidation device 34, and by performing dehumidification on the deoxidized atmospheric gas using the dehumidification device 35 or 36, the dew point is decreased to about −60° C. Switching between the dehumidification devices 35 and 36 is performed by operating the switching valves 46 and 51.

The gas having a decreased dew point is let flow through the heat exchanger 30, and then returned into the heating zone 3 and the connection part 13 between the soaking zone 4 and the cooling zone 5 through the gas delivery ports 23*a* through 23*e*. By letting the gas having a decreased dew point flow through the heat exchanger 30, it is possible to increase the temperature of the gas which is delivered into the furnace.

By locating the gas suction ports and the gas delivery ports in a manner described above, and by appropriately controlling the amounts of the gas which is suctioned through the various suction ports and the gas which is delivered through the various gas delivery ports, since stagnation of the atmospheric gas can be prevented in the upper parts, middle parts and lower parts of the soaking zone and the former part of the cooling zone, it is possible to prevent the dew point from becoming high in the upper part of the furnace.

It is needless to say that it is advantageous that the amount of gas which is charged into the refiner be as large as possible in order to decrease the dew point. However, in the case where the amount is large, there is an increase in facility cost due to an increase in the diameters of line pipes and in the sizes of the dehumidification and deoxidation devices. Therefore, it is important to achieve a target dew point with smallest flow rate of the gas which is charged into the refiner. By locating the gas suction ports into the refiner and the gas delivery ports from the refiner in a manner described above, it is possible to achieve a target dew point with a small flow rate of the gas which is charged into the refiner.

As a result, since it is possible to decrease the time until the dew point of the furnace atmosphere is decreased to −30° C. or lower so that manufacturing of steel strip can be stably performed by decreasing moisture concentration and/or oxygen concentration in a furnace atmosphere before performing a regular operation in which a steel strip is subjected to a continuous heat treatment or when there is an increase in moisture concentration and/or oxygen concentration in the furnace atmosphere during a regular operation, a decrease in productivity can be prevented. In addition, it is possible to decrease the dew point to −40° C. or lower, and, further, to −45° C. or lower, in the soaking zone and the connection part between the soaking zone and the cooling zone. Moreover, by preventing stagnation of the atmospheric gas in the upper part, middle part and lower part of the latter part of the heating zone, it is also possible to decrease the dew point to −45° C. or lower, and, further, to −50° C. or lower, in the latter part of the heating zone, the soaking zone and the connection part between the soaking zone and the cooling zone.

Moreover, by placing dew point meters for determining the dew point of the furnace gas at plural positions in the heating zone and the soaking zone, the dew point is determined in the state without using the refiner. By preferentially suctioning the furnace gas from positions where the dew point is high and by delivering the gas which is returned from the refiner into the upper part of the heating zone, it is possible to achieve a target low dew point with a small flow rate of the gas which is charged into the refiner.

A position where the dew point is high is basically defined as a position where the dew point is higher than the standard value which is the average of the dew points of the heating zone, the soaking zone and the connection part between the soaking zone and cooling zone. However, in the case of some steel grades, since surface concentration does not occur in the heating zone due to the temperature of a steel strip being low in this zone, there is a case where it is necessary to prevent surface concentration in the soaking zone and the connection part between the soaking zone and the cooling zone. In this case, it is appropriate that a position where the dew point is high is defined as a position where the dew point is higher than the standard value which is the average of the dew points of the soaking zone and the connection part between the soaking zone and cooling zone.

Although the furnace gas may be suctioned from all the positions where the dew point is not lower than the average value in order to decrease the dew point of the furnace gas, it is disadvantageous from the viewpoint of cost. Therefore, it is effective to suction the furnace gas from one or plural positions selected in descending order of dew point from among positions where the dew point is not lower than the average value or to suction the furnace gas from the positions downstream of the selected positions in the gas flow direction in consideration of the gas flow in the furnace.

The phrase "to preferentially suction the furnace gas" means that the flow rate of the furnace gas which is suctioned from the selected suction positions is equal to or larger than the average flow rate. The phrase "to preferentially deliver the furnace gas" means that the flow rate of the furnace gas which is delivered from the selected positions is equal to or larger than the average flow rate. The number of suction ports or delivery ports for one position may be one or plural. This is because the optimum number of ports varies depending on, for example, a necessary flow rate, a line pipe diameter and facility cost, and because this is a matter to be optimized in consideration of various conditions.

For example, in the case where a total suction flow rate is 1200 $Nm^3$/hr and the number of gas suction positions is 4, since the average/flow rate is 300 $Nm^3$/hr, the flow rate of the selected suction positions is equal to or more than the average flow rate, that is, 300 $Nm^3$/hr or more. That is also the case with a delivery flow rate, and, in the case where a total delivery flow rate is 1200 $Nm^3$/hr and the number of gas delivery positions is 4, the flow rate of the selected delivery positions is equal to or more than the average flow rate, that is, 300 $Nm^3$/hr or more.

In the case of the continuous annealing furnace described above, although a preheating furnace is not placed upstream of the heating zone, a preheating, furnace may be placed.

Although the embodiment of the present invention is described above in the case of a CGL, the present invention may be applied to a continuous annealing line (CAL) in which a steel strip is continuously annealed.

Using the effects described above, since it is possible to decrease the time until the dew point of the furnace atmosphere is decreased to −30° C. or lower so that manufacturing of steel strip can be stably performed by decreasing moisture concentration and/or oxygen concentration in a furnace atmosphere before performing a regular operation in which a steel strip is subjected to a continuous heat treatment or when there is an increase in moisture concentration and/or oxygen concentration in the furnace atmosphere during a regular operation, a decrease in productivity can be prevented. In addition, it is possible to stably achieve an atmosphere having a low dew point of −40° C. or lower in which problems of pickup defects and furnace wall damage are less likely to occur and which has an excellent effect for preventing easily oxidized chemical elements such as Si and Mn in steel from being concentrated in the surface of a steel strip and forming oxides of easily oxidized chemical elements such as Si and Mn when annealing is performed. As a result, it is possible to easily manufacture some steel grades such as Ti-based IF steel for which an operation in an atmosphere having a high dew point is not desirable.

Example 1

Using an ART type (all radiant type) CGL (having an annealing furnace length (total pass length of a steel strip in the annealing furnace) of 400 m and a furnace height of a heating zone and a soaking zone of 20 m) illustrated in FIG. 1, dew point determining test was performed. The furnace width (W) of the heating zone was 12 m and the furnace width of the soaking zone was 4 m, which resulted in the total furnace width of the heating zone and the soaking zone being 16 m.

Atmospheric gas feeding positions from the outside of the furnace were, in the soaking zone, located at positions 1 m and 10 m higher than the hearth on the driving side with 3 positions in a line in the longitudinal direction being located on each height, that is, 6 positions in total, and, in the heating zone, located at positions 1 m and 10 m higher than the hearth on the driving side with 8 positions in a line in the longitudinal direction being located on each height, that is, 16 positions in total. The dew point of the atmospheric gas fed was −60° C.

Positions where gas suction ports into the refiner, gas delivery ports from the refiner and dew point sensing, stations are located are illustrated in FIG. 2. In FIG. 2, two-dot chain lines represent the positions in the vertical direction of the centers of the upper hearth rolls and the lower hearth rolls in the heating zone and the soaking zone.

Gas suction ports into the refiner were respectively located in the throat part in the lower part of the connection part between the soaking zone and the cooling zone (22*e*: "lower part of the connection part"), at a position 1 m lower than the center of the upper hearth rolls of the soaking zone (22*b*: "upper part of the soaking zone"), at the center of the soaking zone (center of the furnace height and the center in the longitudinal direction of the furnace: 22*c*: "center of the soaking zone"), at a position 1 m higher than the center of the lower hearth rolls of the soaking zone (22*d*: "lower part of the soaking zone") and at the center of the heating zone (center of the furnace height and center in the longitudinal direction of the furnace: 22*a*: "center of the heating zone").

Regarding gas delivery ports from the refiner into the furnace, one gas delivery port was located 1 m from the furnace wall on the exit side of the connection part between the soaking zone and the cooling zone and 1 m from the ceiling (23*e*: "connection part"), and, in the heating zone, 4 gas delivery ports (23*a* through 23*d*) were located at a position 1 m lower than the center of the upper hearth rolls at intervals of 2 m in the longitudinal direction of the furnace starting at 1 m from the furnace wall on the entrance side (23*a* through 23*d*: "upper part of the heating zone-first to fourth from entrance side"). Here, the suction port had a diameter of ϕ200 mm, and one group consisted of a pair of suction ports which were separated by 1 m in the longitudinal direction of the furnace in the case of the suction ports other than that in the connection part where the one suction port was separately located. The gas delivery port had a diameter of ϕ50 mm, and one of the gas delivery ports was separately located in the connection part.

Dew point sensing stations for the furnace gas were respectively located in the connection part between the soaking zone and cooling zone (24*g*: "connection part"), at an intermediate position between the third and fourth gas delivery ports from the entrance side of the heating zone (24*a*: "upper part of the heating zone"), at an intermediate position between the 2 suction ports of each of the suction port pair located in the soaking zone and the heating zone (24*b* and 24*d* through 24*f*: "center of the heating zone", "upper part of the soaking zone", "center of the soaking zone" and "lower part of the soaking zone"). The dew point sensing stations (24*a*, 24*b* and 24*d* through 24*f*) in the heating zone and the soaking zone described above were located at the centers of the heating zone and the soaking zone in the longitudinal direction of the furnace and at the same heights as the gas suction ports or the gas delivery ports. In order to determine the dew point of the center in the longitudinal direction of the furnace of the lower part of the heating zone, the dew point sensing station was also located at a position 1 m higher than the center of the lower hearth rolls in the heating zone and of 6 m (center in the longitudinal direction of the furnace) from the furnace wall on the entrance side (24*c*: "lower part of the heating zone").

The gas delivery rates of the individual gas delivery ports in the connection part between the soaking zone and the cooling zone and the heating zone were separately controlled. The gas suction rate of the gas suction port in the throat part in the lower part of the connection part between the soaking zone and cooling zone was separately controlled, and the gas suction rates of the individual gas suction port groups in the soaking zone and the heating zone were controlled separately from other groups. In addition, it was possible to select a position of the gas suction port in the soaking zone and the heating zone on the basis of the dew point data of the centers of the soaking zone and the heating zone.

A synthesis zeolite catalyst was used for the dehumidification device of the refiner and a palladium catalyst was used for the deoxidation device.

Using steel strips having a thickness of 0.8 to 1.2 mm and a width of 950 to 1000 mm, tests were conducted under as unified conditions as possible such that the annealing temperature was 800° C. and the steel strip traveling speed was 100 to 120 mpm. The alloying elements of the steel strip are given in Table 1.

TABLE 1

(mass %)

| C | Si | Mn | S | Al |
|---|---|---|---|---|
| 0.12 | 1.3 | 2.0 | 0.003 | 0.03 |

$H_2$—$N_2$ gas (having an $H_2$ concentration of 10 vol % and a dew point of −60° C.) was fed into the furnace as an atmospheric gas, and, on the basis of the dew point (initial dew point, −34° C. to −36° C.) which was determined when the refiner was not used, the dew point which was determined after 1 hour of the operation of the refiner was investigated.

The initial dew point distribution (dew points when the refiner was not used) and the effects of decreasing the dew points depending on the positions of the suction ports into the refiner and delivery ports from the refiner are given in Table 2. Here, various items (written in " " above) in Table 2 correspond to various suction ports, delivery ports and dew point sensing stations in a manner described above.

TABLE 2

| | | Dew Point | | | | | | | Suction Rate of Suction Mouth | |
|---|---|---|---|---|---|---|---|---|---|---|
| No. | Class of Base Condition | Connection Part ° C. | Upper Part of Soaking Zone ° C. | Center of Soaking Zone ° C. | Lower Part of Soaking Zone ° C. | Upper Part of Heating Zone ° C. | Center of Heating Zone ° C. | Lower Part of Heating Zone ° C. | Lower Part of Connection Part $Nm^3/hr$ | Upper Part of Soaking Zone $Nm^3/hr$ |
| 1 | A | −34.2 | −32.3 | −32.6 | −34.7 | −37.6 | −37.6 | −37.2 | 0 | 0 |
| 2 | A | −51.9 | −52.0 | −52.2 | −52.4 | −52.0 | −52.1 | −51.7 | 300 | 1200 |
| 3 | A | −50.2 | −47.4 | −46.9 | −47.6 | −46.6 | −46.2 | −44.7 | 300 | 1200 |
| 4 | A | −50.5 | −46.9 | −46.4 | −47.1 | −46.9 | −46.0 | −44.3 | 300 | 1200 |
| 5 | A | −50.9 | −48.8 | −49.1 | −49.3 | −47.5 | −47.3 | −46.1 | 300 | 1200 |
| 6 | A | −51.2 | −51.2 | −51.5 | −51.7 | −50.6 | −50.3 | −50.2 | 300 | 1200 |
| 7 | A | −51.8 | −50.7 | −50.9 | −51.6 | −51.6 | −51.3 | −51.0 | 300 | 0 |
| 8 | A | −51.8 | −47.1 | −47.6 | −47.8 | −48.2 | −48.1 | −47.5 | 300 | 0 |
| 9 | A | −47.8 | −43.4 | −44.0 | −44.9 | −41.8 | −40.8 | −38.9 | 300 | 0 |
| 10 | B | −37.2 | −37.1 | −36.9 | −36.5 | −33.9 | −33.1 | −32.7 | 0 | 0 |
| 11 | B | −51.3 | −51.3 | −51.3 | −50.8 | −51.4 | −50.7 | −50.9 | 300 | 0 |
| 12 | B | −50.1 | −46.9 | −46.1 | −46.2 | −45.7 | −44.9 | −43.8 | 300 | 0 |
| 13 | B | −51.2 | −46.9 | −46.7 | −46.8 | −47.3 | −45.6 | −44.1 | 300 | 0 |
| 14 | B | −51.0 | −49.2 | −49.1 | −47.8 | −49.9 | −47.4 | −47.3 | 300 | 0 |
| 15 | B | −51.8 | −50.8 | −50.9 | −50.5 | −50.9 | −50.8 | −50.9 | 300 | 0 |
| 16 | B | −51.3 | −47.0 | −46.9 | −47.2 | −49.1 | −48.7 | −48.1 | 300 | 0 |
| 17 | A | −36.1 | −32.6 | −36.2 | −37.6 | −35.6 | −33.0 | −34.4 | 0 | 0 |

TABLE 2-continued

| | | | | | | | | | | |
|---|---|---|---|---|---|---|---|---|---|---|
| 18 | A | −51.9 | −52.1 | −52.2 | −52.3 | −51.3 | −50.3 | −50.6 | 300 | 1200 |
| 19 | A | −51.9 | −51.9 | −52.1 | −52.3 | −52.3 | −52.5 | −51.8 | 300 | 600 |

| | Suction Rate of Suction Mouth | | | Delivery Rate of Delivery Mouth | | | | | |
|---|---|---|---|---|---|---|---|---|---|
| No. | Center of Soaking Zone $Nm^3/hr$ | Lower Part of Soaking Zone $Nm^3/hr$ | Center of Heating Zone $Nm^3/hr$ | Connection Part $Nm^3/hr$ | 1st from Entrance Side in Upper Part of Heating Zone $Nm^3/hr$ | 2nd from Entrance Side in Upper Part of Heating Zone $Nm^3/hr$ | 3rd from Entrance Side in Upper Part of Heating Zone $Nm^3/hr$ | 4th from Entrance Side in Upper Part of Heating Zone $Nm^3/hr$ | Note |
| 1 | 0 | 0 | 0 | 0 | 0 | 0 | 0 | 0 | Comparative Example |
| 2 | 0 | 0 | 0 | 300 | 300 | 300 | 300 | 300 | Example |
| 3 | 0 | 0 | 0 | 0 | 1200 | 0 | 0 | 0 | Example |
| 4 | 0 | 0 | 0 | 0 | 0 | 0 | 0 | 1200 | Example |
| 5 | 0 | 0 | 0 | 0 | 600 | 600 | 0 | 0 | Example |
| 6 | 0 | 0 | 0 | 0 | 400 | 400 | 400 | 0 | Example |
| 7 | 1200 | 0 | 0 | 300 | 300 | 300 | 300 | 300 | Example |
| 8 | 0 | 0 | 1200 | 300 | 300 | 300 | 300 | 300 | Example |
| 9 | 0 | 0 | 0 | 300 | 300 | 300 | 300 | 300 | Comparative Example (Suction at 1200 $Nm^3/hr$ from Suction Port-Free Area *1) |
| 10 | 0 | 0 | 0 | 0 | 0 | 0 | 0 | 0 | Comparative Example |
| 11 | 0 | 0 | 1200 | 300 | 300 | 300 | 300 | 300 | Example |
| 12 | 0 | 0 | 1200 | 0 | 1200 | 0 | 0 | 0 | Example |
| 13 | 0 | 0 | 1200 | 0 | 0 | 0 | 0 | 1200 | Example |
| 14 | 0 | 0 | 1200 | 0 | 600 | 600 | 0 | 0 | Example |
| 15 | 0 | 0 | 1200 | 0 | 400 | 400 | 400 | 0 | Example |
| 16 | 0 | 1200 | 0 | 0 | 400 | 400 | 400 | 0 | Example |
| 17 | 0 | 0 | 0 | 0 | 0 | 0 | 0 | 0 | Comparative Example |
| 18 | 0 | 0 | 0 | 300 | 300 | 300 | 300 | 300 | Example |
| 19 | 0 | 0 | 600 | 300 | 300 | 300 | 300 | 300 | Example |

*1) Suction Port-Free Area: an area within 6 m in the vertical direction and 3 m in the longitudinal direction of the furnace from the steel sheet entrance in the lower part of the heating zone Base conditions were classified into two groups A and B based on which of the heating zone and the soaking zone had the higher dew point. A represents a case where the soaking zone had a higher dew point than the heating zone, and B represents the heating zone had a higher dew point than the soaking zone.

In the case of the examples of the present invention, under any one of the base conditions, the dew points of the heating zone (other than the lower part of the heating zone), the soaking zone and the connection part between the soaking zone and the cooling zone were decreased to −45° C. or lower. In addition, it is clarified that, under any one of the base conditions, the dew points of the heating zone, soaking zone and the connection part between the soaking zone and the cooling zone were able to be decreased to −50° C. or lower, by suctioning the gas into the refiner through the suction ports at the positions where the dew point was high when determined with the refiner not being used (Nos. 1 and 10 in Table 2), and by controlling the delivery width from the refiner into the heating zone to be larger than ¼ of the furnace width of the heating zone.

In contrast, in the case of test No. 9 in Table 2 where a gas suction port into the refiner is located in an area within 6 m in the vertical direction and 3 m in the longitudinal direction of the furnace from the steel strip entrance in the lower part of the heating zone and where the same amount of gas as the examples of the present invention was suctioned, the dew point was generally high and −40° C. or higher at some positions.

Here, "a position where the dew point is high" means a position described below. That is, an average dew point Da and a standard deviation σ are derived from the dew points of all the positions, and positions having the dew point equal to or higher than Da+σ are all positions where the dew point is high. However, a suction port-free area in the lower part of the heating zone is not included. In the case where there are plural positions where the dew point is high, although the gas may be suctioned from any one of the positions, it is preferable that the gas be suctioned from plural positions in the case where a sufficient amount of gas cannot be suctioned from one position due to the gas flow in the furnace.

In the case where the gas is suctioned from plural positions, although it is ideal that the flow rate of a position increases with increasing dew point of the position, since the difference in dew point among the positions concerned is not so large in many cases, it is usually appropriate that the same flow rate is assigned to the positions concerned. In the case where the flow rate of a position increases with increasing dew point of the position, the flow rate may be determined using, for example, the method described below.

i) The dew point Dp (° C.) of the position from which the gas is suctioned is converted to a volume moisture fraction Wr (ppm). It is appropriate that the dew point is converted to a moisture fraction using, for example, equation (1) below.

[Equation 1]

$$Wr = 3.425 \times 10^{13} \times \exp\left(-\frac{6137}{Dp + 273.15}\right) \quad (1)$$

ii) The flow rate of a position is determined in proportion to the moisture fraction of the position. For example, in the case where the positions concerned are three positions A, B and C described below and where the total suction rate is 1000 $Nm^3$/hr, the flow rate is determined in the following manner:

A: dew point; −30.4° C. (=volume moisture fraction; 359 ppm),

B: dew point; −31.2° C. (=volume moisture fraction; 330 ppm),

C: dew point; −30.8° C. (=volume moisture fraction; 344 ppm)

suction rate at $A$=1000×359/(359+330+344)=348 $Nm^3$/hr, suction rate at $B$=1000×330/(359+330+344)=319 $Nm^3$/hr, and suction rate at $C$=1000×344/(359+330+344)=333 $Nm^3$/hr.

Example 2

Using the ART type (all radiant type) CGL illustrated in FIG. 1 which was used in EXAMPLE 1, the decreasing trend of the dew point was investigated.

The conditions of the conventional method (in which a refiner was not used) were as follows. That is, the atmospheric gas which was fed into the furnace consisted of $H_2$: 8 vol % and the balance being $N_2$ and inevitable impurities (having a dew point of −60° C.), the amount of gas fed to the cooling zone and the downstream part thereof: 300 $Nm^3$/hr, the amount of gas fed to the soaking zone: 100 $Nm^3$/hr, and the amount of gas fed to the heating zone: 450 $Nm^3$/hr. In addition, using a steel strip having a thickness of 0.8 to 1.2 mm and a width of 950 to 1000 mm (containing the same alloying elements as given in Table 1), an annealing temperature was 800° C., and a steel strip traveling speed was 100 to 120 mpm.

Figure 4:
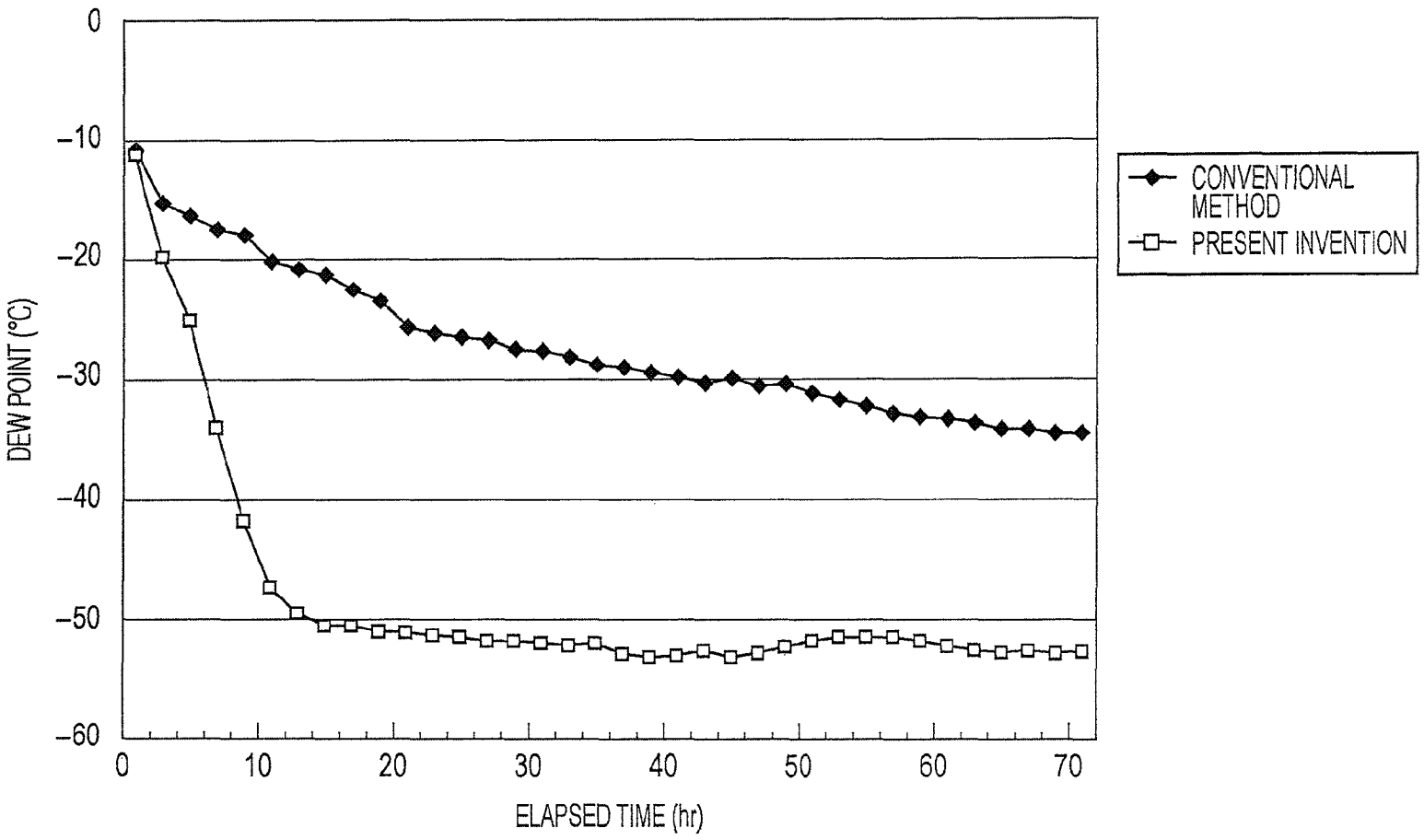
FIG. 4 is a diagram illustrating the trends in the decrease of the dew point of an annealing furnace.

The conditions of the method according to the present invention were the same as described above, and, further, using a refiner, the conditions of No. 2 (the optimum conditions under base condition A) in Table 2 were used as conditions regarding suction positions and the like, because the initial dew point distribution was similar to base condition A (the dew point was highest at the upper part of the soaking zone). The investigation results are illustrated in FIG. 4. The dew point represents the dew point of the upper part of the soaking zone.

In the case of the conventional method, it took about 40 hours to decrease the dew point to −30° C. or lower, and it was impossible to decrease the dew point to −35° C. even after 70 hours. In contrast, in the case of the present invention, it was possible to decrease the dew point to −30° C. or lower in 6 hours, to −40° C. or lower in 9 hours and to −50° C. or lower in 14 hours.

The present invention can be used as a method for annealing a steel strip with which it is possible to decrease the dew point of the furnace atmosphere in a short time to −30° C. or lower so that manufacturing of steel strip can be stably performed by decreasing moisture concentration and/or oxygen concentration in a furnace atmosphere before performing a regular operation in which a steel strip is subjected to a continuous heat treatment or when there is an increase in moisture concentration and/or oxygen concentration in the furnace atmosphere during a regular operation.

The present invention is effective for an annealing furnace having a dividing wall between the soaking zone and the heating zone, and can be used as a method for annealing a high-strength steel strip containing easily oxidized chemical elements such as Si and Mn with fewer problems of pickup defects and furnace wall damage.

REFERENCE SIGNS LIST

1 steel strip
2 annealing furnace
3 heating zone
4 soaking zone
5 cooling zone
5*a* first cooling zone
5*b* second cooling zone
6 snout
7 galvanizing bath
8 gas wiping nozzle
9 heating apparatus
10 refiner
11*a* upper hearth roll
11*b* lower hearth roll
12 dividing wall
13 connection part
14 throat part
15 roll
16 seal roll
17 atmospheric gas feeding system
18 gas charging pipe
19 gas discharging pipe
22*a* to 22*e* gas suction port
23*a* to 23*e* gas delivery port
24*a* to 24*g* dew point sensing station
30 heat exchanger
31 cooler
32 filter
33 blower
34 deoxidation device
35, 36 dehumidification device
46, 51 switching valve
40 to 45, 47 to 50, 52, 53 valve

The invention claimed is:

1. A continuous annealing furnace for a steel strip, the furnace being a vertical annealing furnace comprising a heating zone, a soaking zone, a cooling zone located in this order through which a steel strip is transferred in the up-and-down direction, the connection part between the soaking zone and the cooling zone being located in the upper part of the furnace, the heating zone and the soaking zone being communicated with each other in the upper part of the furnace, a dividing wall being placed in a part of the furnace other than the communicated parts in the upper part of the furnace to physically separate the heating zone and the soaking zone, an atmospheric gas being fed into the furnace from the outside of the furnace, and the furnace gas being discharged through a steel strip entrance in the lower part of the heating zone while a refiner having a deoxidation device and a dehumidification device which is placed outside the furnace such that part of the furnace gas is suctioned into the refiner to decrease the dew point of the gas by removing oxygen and moisture from the gas and the resultant gas having a decreased dew point is returned into the furnace through a gas delivery port, wherein a gas suction port from the furnace into the refiner is located at a position where a flow channel narrows at a throat part or a position in the vicinity of seal rolls in the lower part of the connection part between the soaking zone and the cooling zone and wherein one or more gas suction ports are located in the parts of the heating zone and/or the soaking zone outside of an area within 6 m in the vertical direction and 3 m in the longitudinal direction of the furnace from the steel strip entrance in the lower part of the heating zone.

2. The continuous annealing furnace for a steel strip according to claim 1, the furnace further comprising a dew point sensing station of a dew point meter for determining the dew point of the furnace gas located in the vicinity of gas suction ports located in the heating zone and the soaking zone.

3. The continuous annealing furnace for a steel strip according to claim 1, the furnace further comprising a plurality of gas delivery ports located in the connection part between the soaking zone and the cooling zone and the upper part of the heating zone, the gas flowing from the refiner to the furnace therethrough, wherein the delivery width W0 of the gas delivery ports located in the upper part of the heating zone satisfies the relationship with the furnace width W of the heating zone that W0/W is larger than ¼, where the delivery width W0 of the gas delivery ports in the heating zone is the distance in the longitudinal direction of the furnace between the gas delivery port located at a position nearest to the entrance of the heating zone and the gas delivery port located at a position nearest to the exit of the heating zone.

4. The continuous annealing furnace for a steel strip according to claim 2, the furnace further comprising a plurality of gas delivery ports, the gas flowing from the refiner to the furnace therethrough, that are located in the connection part between the soaking zone and the cooling zone and the upper part of the heating zone, wherein the delivery width W0 of the gas delivery ports located in the upper part of the heating zone satisfies the relationship with the furnace width W of the heating zone that W0/W is larger than ¼, where the delivery width W0 of the gas delivery ports in the heating zone is the distance in the longitudinal direction of the furnace between the gas delivery port located at a position nearest to the entrance of the heating zone and the gas delivery port located at a position nearest to the exit of the heating zone.

5. A continuous galvanizing apparatus for a steel strip, the apparatus comprising a galvanizing apparatus installed downstream of the annealing furnace according to claim 1.

6. A continuous galvanizing apparatus for a steel strip, the apparatus comprising a galvanizing apparatus installed downstream of the annealing furnace according to claim 2.

7. A continuous galvanizing apparatus for a steel strip, the apparatus comprising a galvanizing apparatus installed downstream of the annealing furnace according to claim 4.

8. A method for continuously annealing a steel strip, the method comprising continuously annealing a steel strip using the continuous annealing furnace for a steel strip according to claim 2, determining the dew point of the furnace gas in the vicinity of the gas suction ports in the heating zone and the soaking zone, suctioning the furnace gas at positions where the dew point is high and delivering the gas returned from the refiner through the gas delivery ports placed in the upper part of the heating zone.

9. The method for continuously annealing a steel strip according to claim 8, wherein the delivery width W1 of a gas delivered from the upper part of the heating zone satisfying the relationship with the furnace width W of the heating zone that W1/W is larger than ¼, where the delivery width W1 of the gas delivery ports is a distance in the longitudinal direction of the furnace between the gas delivery port delivering the gas from the position nearest to the entrance of the heating zone and the gas delivery port delivering the gas from the position nearest to the exit of the heating zone.

10. A method for manufacturing a galvanized steel strip, the method further comprising performing galvanization after performing the continuous annealing of a steel strip using the method according to claim 8.

11. A method for continuously annealing a steel strip, the method comprising continuously annealing a steel strip using the continuous annealing furnace for a steel strip according to claim 1, determining the dew point of the furnace gas in the vicinity of the gas suction ports in the heating zone and the soaking zone, suctioning the furnace gas at positions where the dew point is high and delivering the gas returned from the refiner through the gas delivery ports placed in the upper part of the heating zone.

12. The method for continuously annealing a steel strip according to claim 11, wherein the delivery width W1 of a gas delivered from the upper part of the heating zone satisfying the relationship with the furnace width W of the heating zone that W1/W is larger than ¼, where the delivery width W1 of the gas delivery ports is a distance in the longitudinal direction of the furnace between the gas delivery port delivering the gas from the position nearest to the entrance of the heating zone and the gas delivery port delivering the gas from the position nearest to the exit of the heating zone.

13. A method for manufacturing a galvanized steel strip, the method further comprising performing galvanization after performing the continuous annealing of a steel strip using the method according to claim 9.

14. A method for manufacturing a galvanized steel strip, the method further comprising performing galvanization after performing the continuous annealing of a steel strip using the method according to claim 11.

15. A method for manufacturing a galvanized steel strip, the method further comprising performing galvanization after performing the continuous annealing of a steel strip using the method according to claim 12.

16. A method for manufacturing a galvanized steel strip, the method further comprising performing galvanization after performing the continuous annealing of a steel strip using the method according to claim 2.

17. A method for continuously annealing a steel strip, the method comprising continuously annealing a steel strip using the continuous annealing furnace for a steel strip according to claim 4, determining the dew point of the furnace gas in the vicinity of the gas suction ports in the heating zone and the soaking zone, suctioning the furnace gas at positions where the dew point is high and delivering the gas returned from the refiner through the gas delivery ports placed in the upper part of the heating zone.

18. The method for continuously annealing a steel strip according to claim 17, wherein the delivery width W1 of a gas delivered from the upper part of the heating zone satisfying the relationship with the furnace width W of the heating zone that W1/W is larger than ¼, where the delivery width W1 of the gas delivery ports is a distance in the longitudinal direction of the furnace between the gas delivery port delivering the gas from the position nearest to the entrance of the heating zone and the gas delivery port delivering the gas from the position nearest to the exit of the heating zone.

19. A continuous galvanizing apparatus for a steel strip, the apparatus comprising a galvanizing apparatus installed downstream of the annealing furnace according to claim 3.

20. A method for manufacturing a galvanized steel strip, the method further comprising performing galvanization after performing the continuous annealing of a steel strip using the method according to claim 17.

* * * * *